US006006551A

United States Patent [19]

Nonnemacher et al.

[11] Patent Number: 6,006,551

[45] Date of Patent: Dec. 28, 1999

[54] TWIN BED FLAT KNITTING MACHINE METHOD FOR WIDENING A TUBULAR FABRIC

[75] Inventors: Thomas Nonnemacher, Pliezhausen; Henning Schmidt, Reutlingen; Juergen Schenk, Hechingen; Achim Ulmer, Gomadingen, all of Germany

[73] Assignee: H. Stoll GmbH & Co., Reutlingen, Germany

[21] Appl. No.: 08/993,296

[22] Filed: Dec. 18, 1997

[30] Foreign Application Priority Data

Dec. 18, 1996 [DE] Germany ..... 196 52 612

[51] Int. Cl.[6] ..... D04B 1/24; D04B 7/10

[52] U.S. Cl. ..... 66/70; 66/76

[58] Field of Search ..... 66/70, 76

[56] References Cited

U.S. PATENT DOCUMENTS

| | | | |
|---|---|---|---|
| 3,668,896 | 6/1972 | Betts et al. | 66/70 |
| 5,692,399 | 12/1997 | Takahashi et al. | 66/70 |
| 5,701,766 | 12/1997 | Takahashi . | |

FOREIGN PATENT DOCUMENTS

| | | |
|---|---|---|
| 0 533 612 A2 | 3/1993 | European Pat. Off. . |
| 2 061 524 | 6/1972 | Germany . |
| 1 417 165 | 12/1975 | United Kingdom . |

*Primary Examiner*—Andy Falik
*Attorney, Agent, or Firm*—Michael J. Striker

[57] ABSTRACT

For mesh widening of a hose-shaped knitted piece on a double bed flat knitting machine knitting a mesh row is knitted in a carriage direction from left to right on a front needle bed and subsequently a mesh row is knitted in the carriage direction from right to left on a rear needle bed. Then a mesh row is knitted in the carriage direction from left to right on the front needle bed and a loop is formed on a previously free edge needle of the front needle bed, a mesh row is formed in the carriage direction from right to left on the rear needle bed, the loop is transferred with a first knitting system in the carriage direction from left to right on an empty needle of the rear needle bed with a further knitting system knitting a mesh row on the front needle bed. Finally, a mesh row is formed in the carriage direction from right to left with cooperation of the edge needle with the loop, a mesh row is knitted in the carriage direction from left to right on the front needle bed, and a mesh row is knitted in the opposite carriage direction of the rear needle bed.

8 Claims, 15 Drawing Sheets

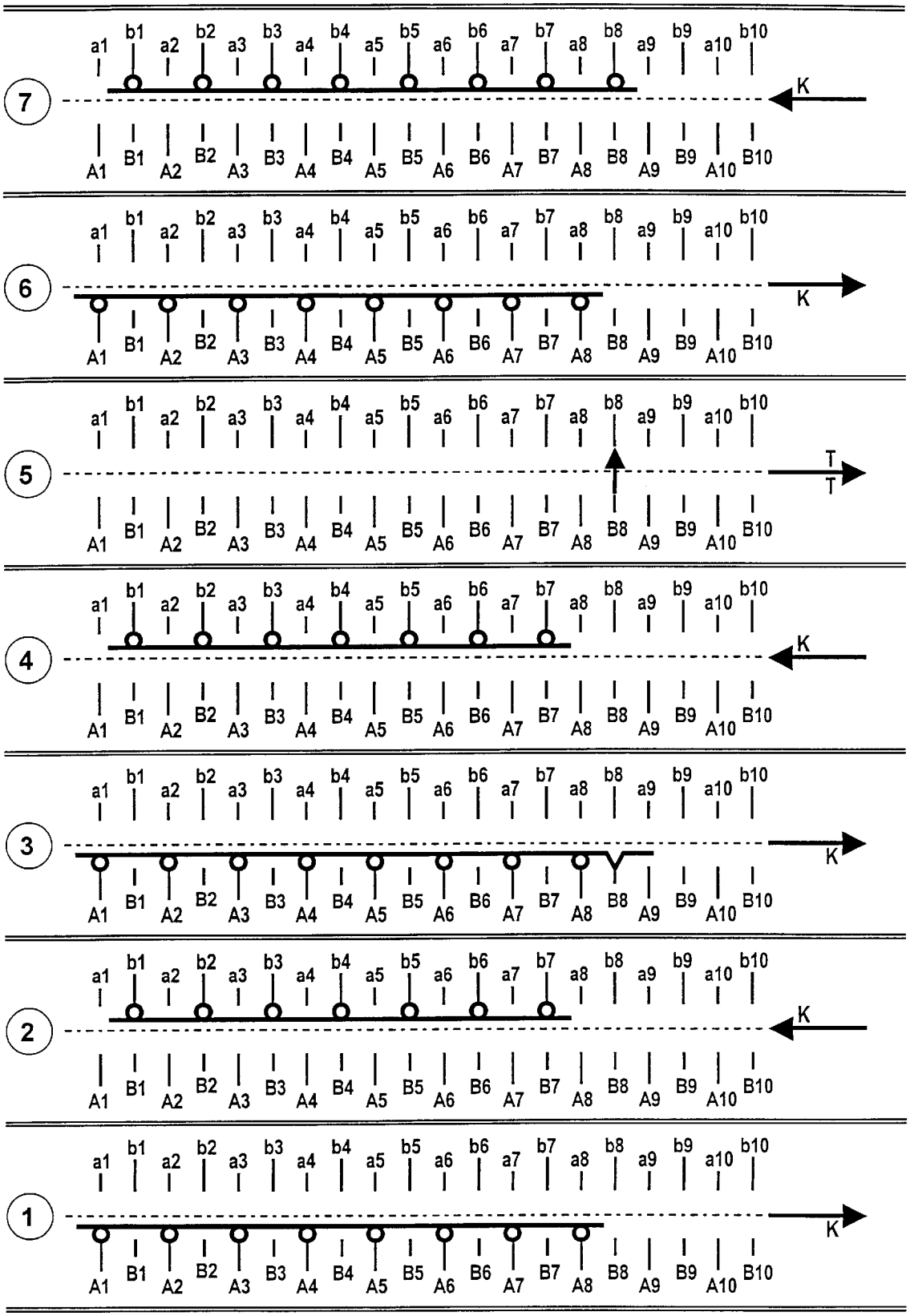
*Fig. 2.1*

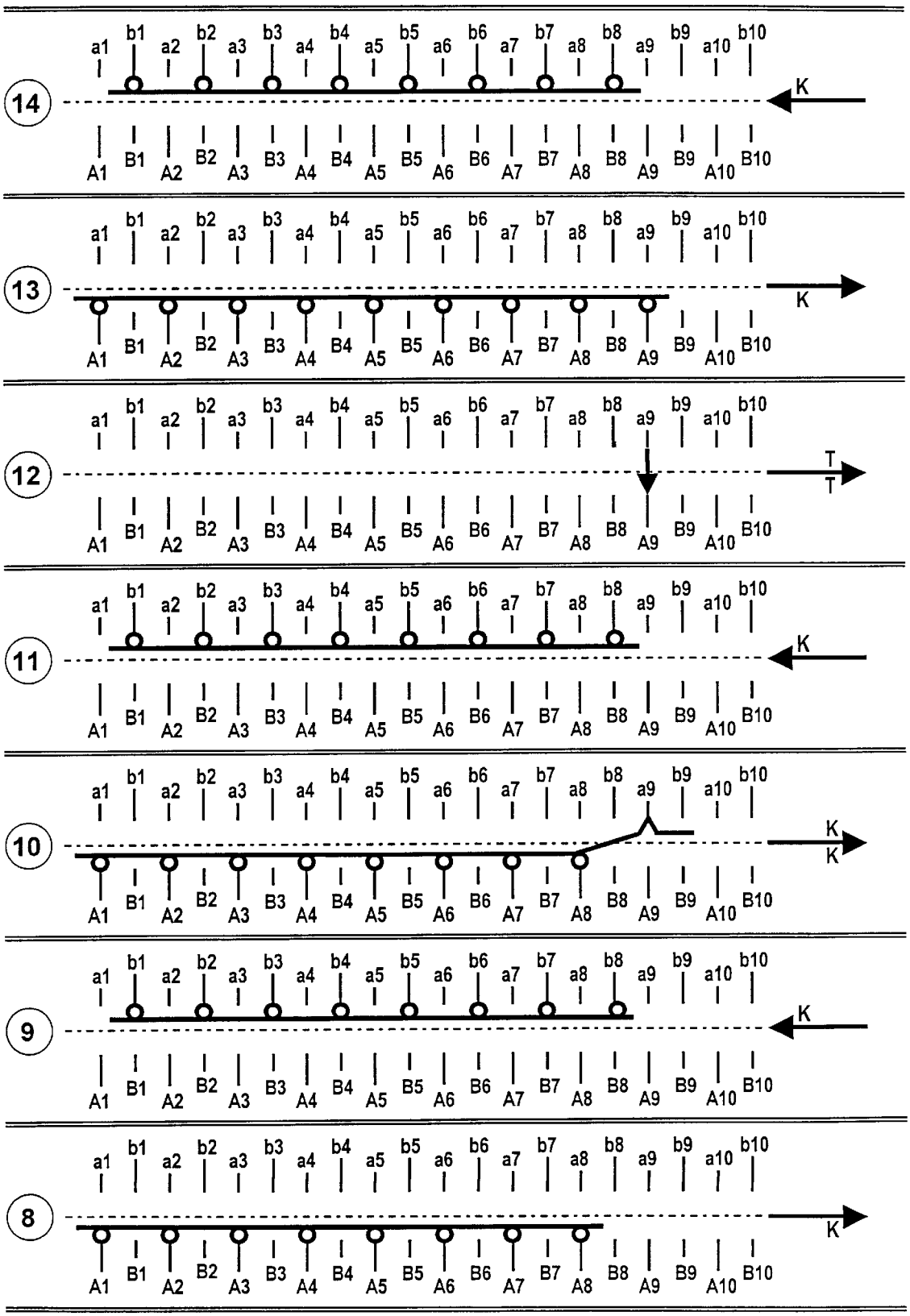
*Fig. 2.2*

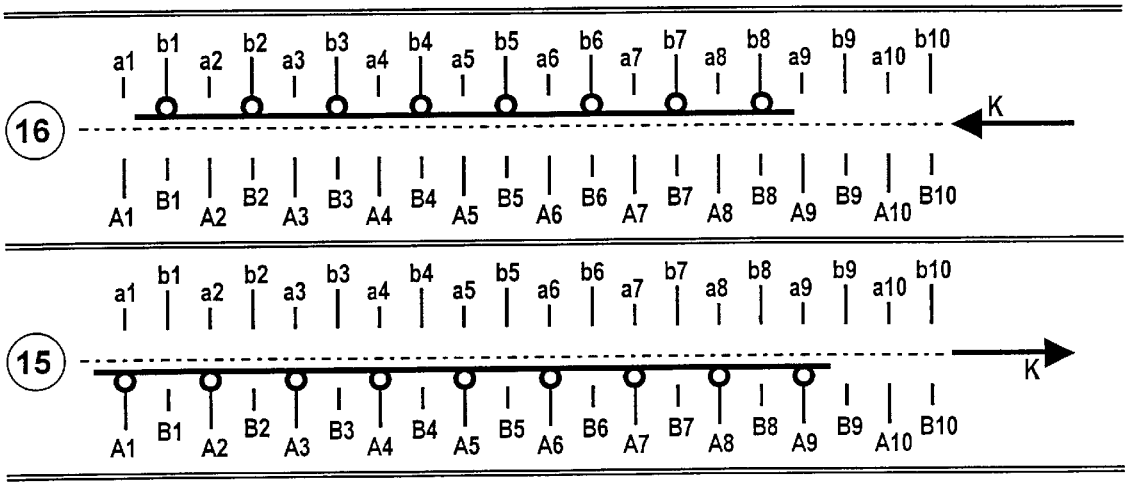
*Fig. 2.3*

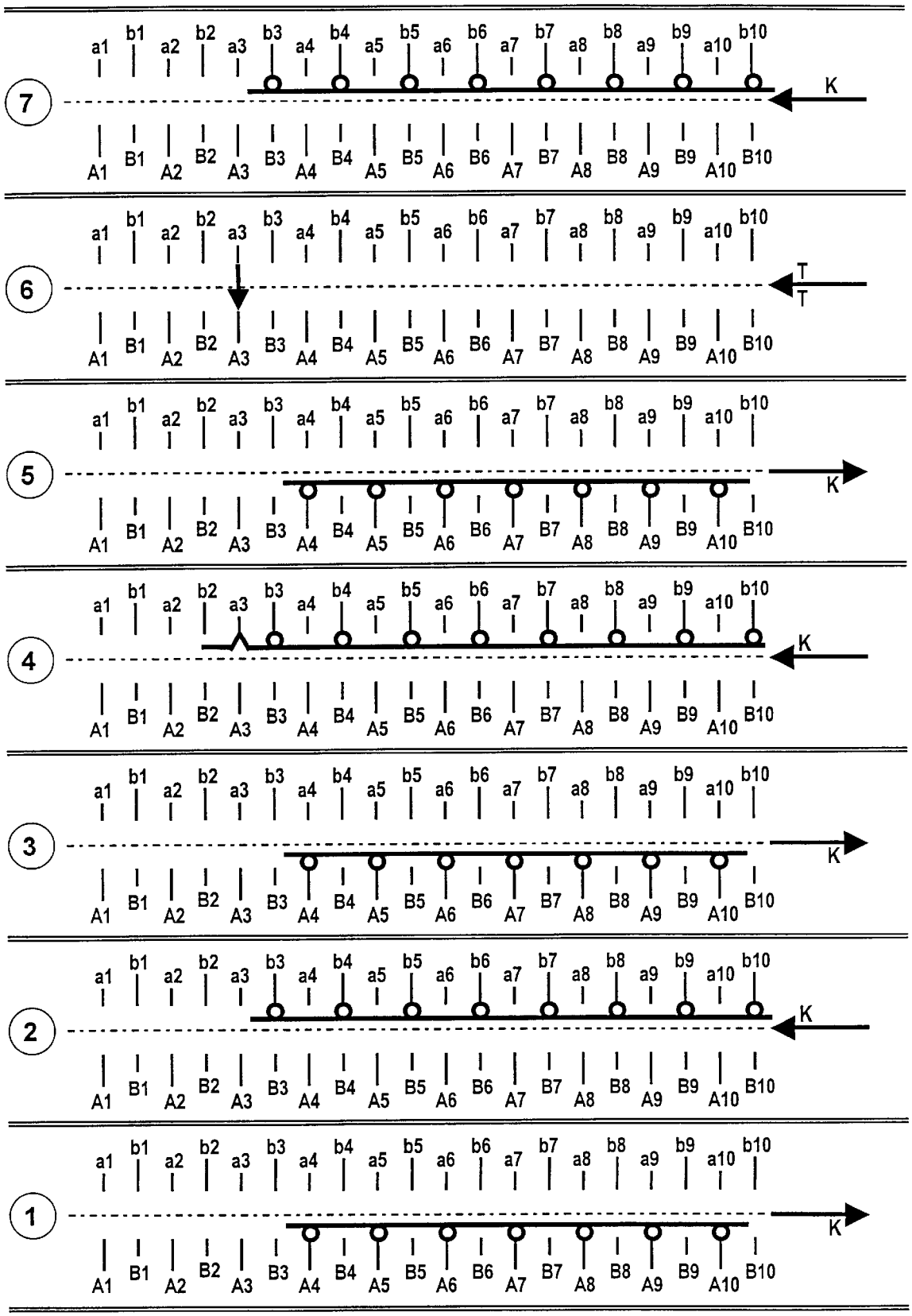
*Fig. 3.1*

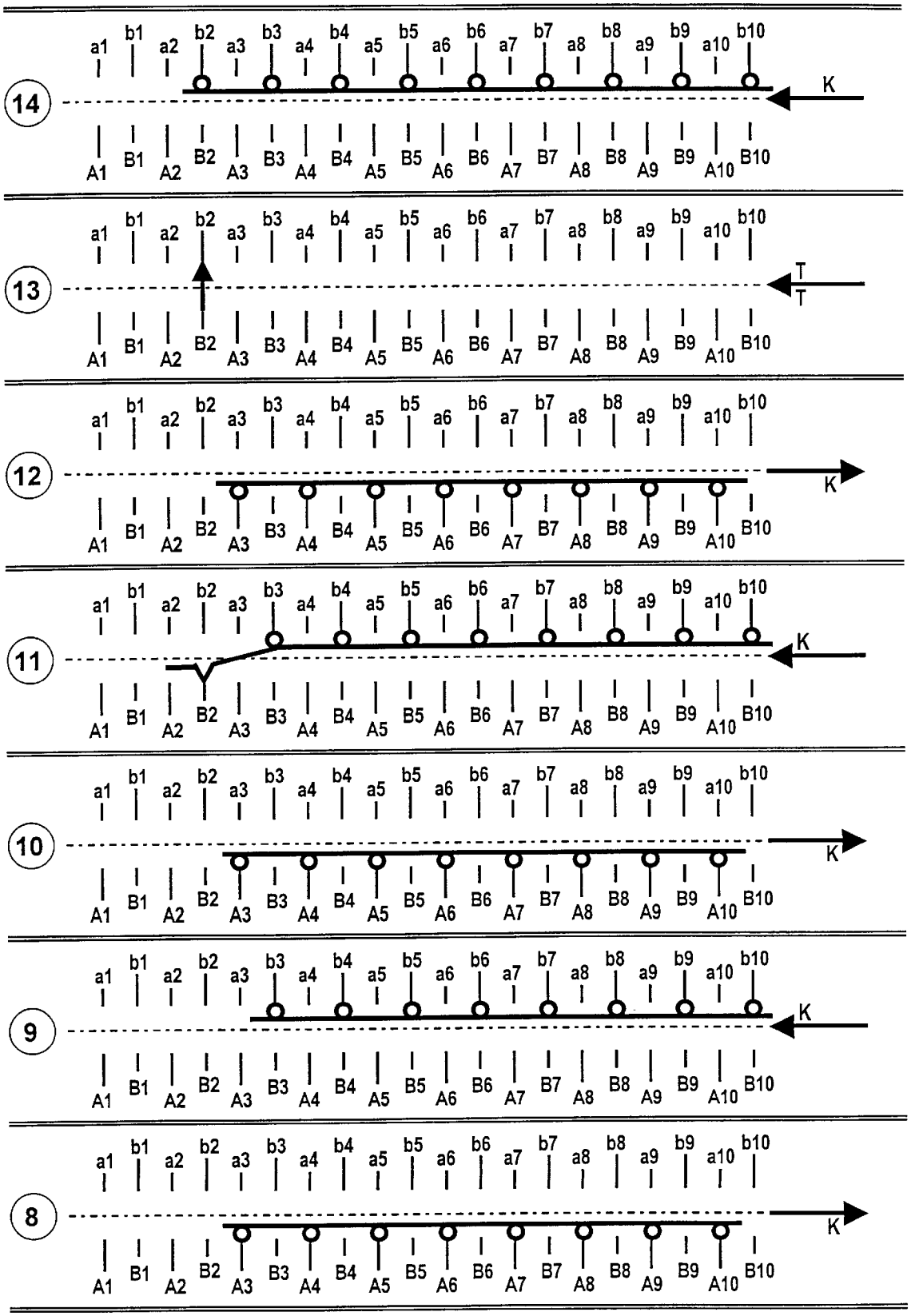
*Fig. 3.2*

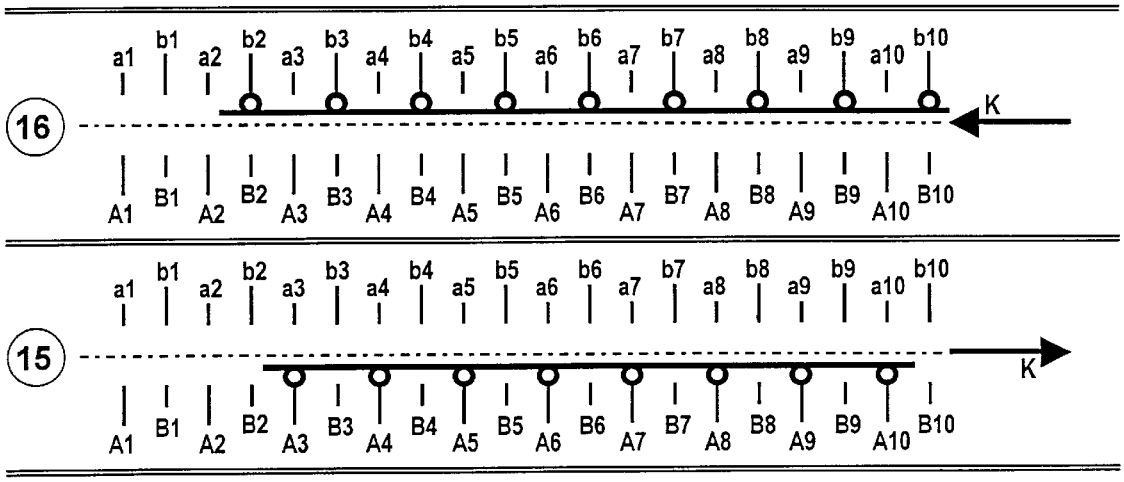
*Fig. 3.3*

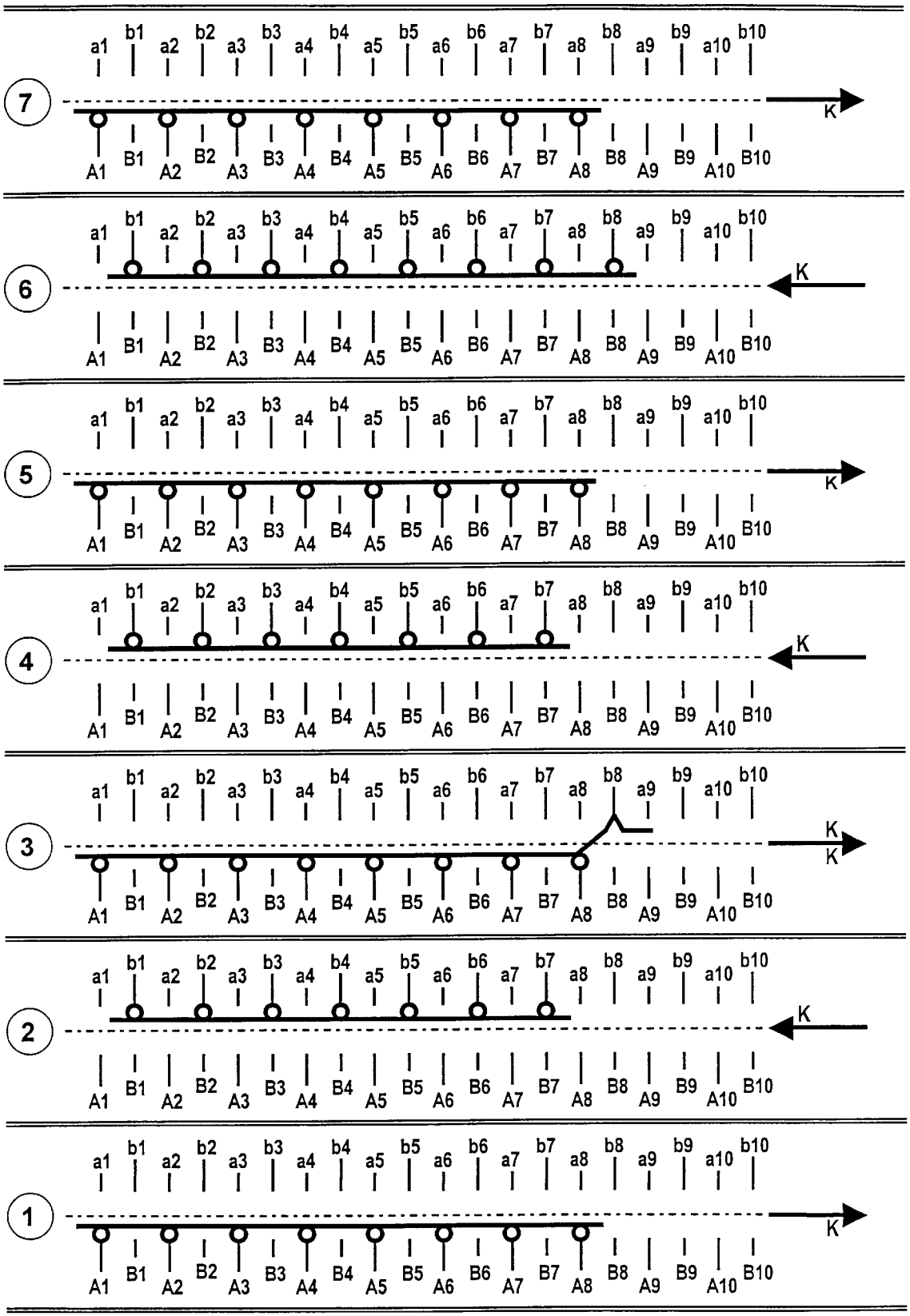
*Fig. 4.1*

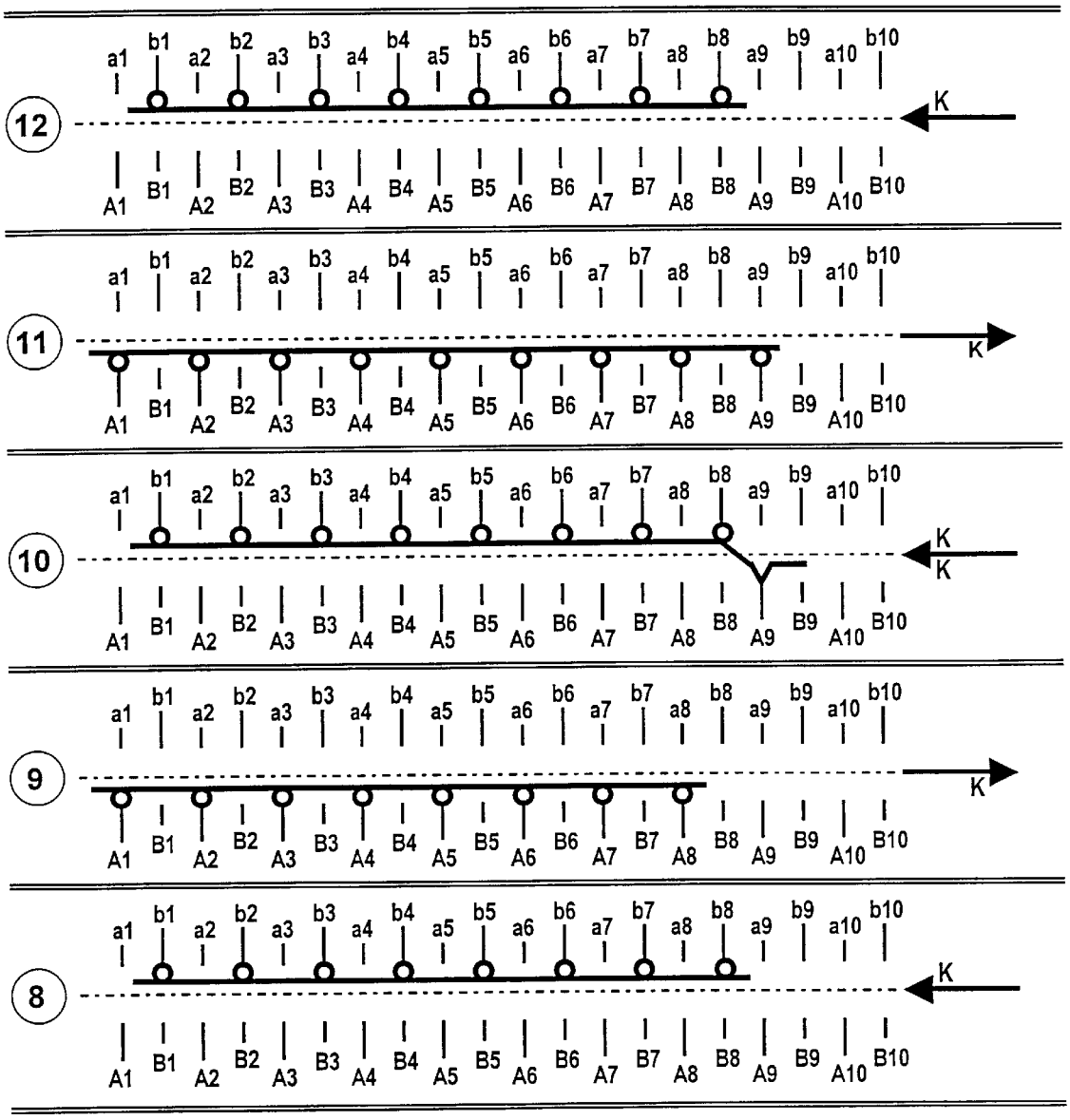
*Fig. 4.2*

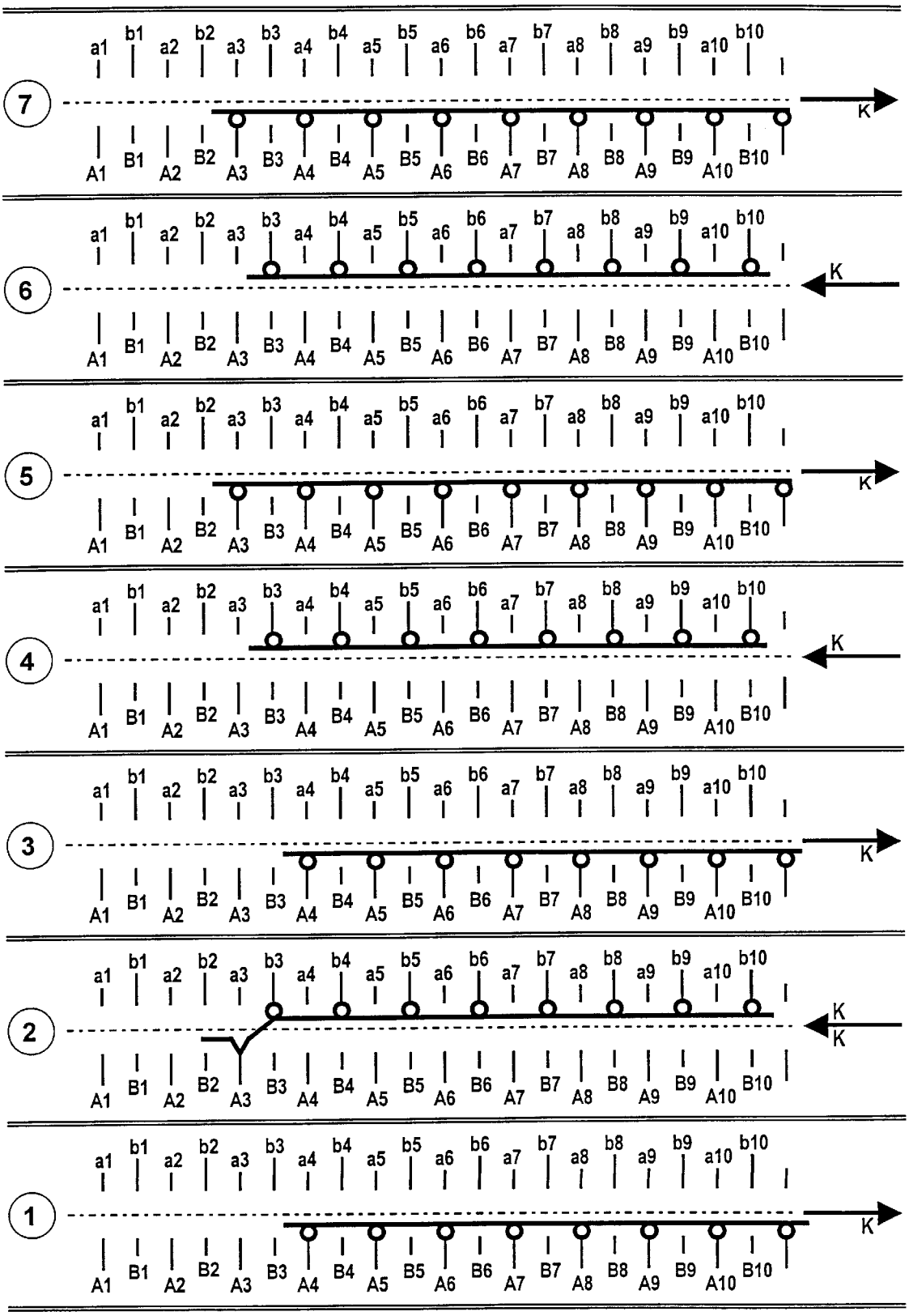
*Fig. 5.1*

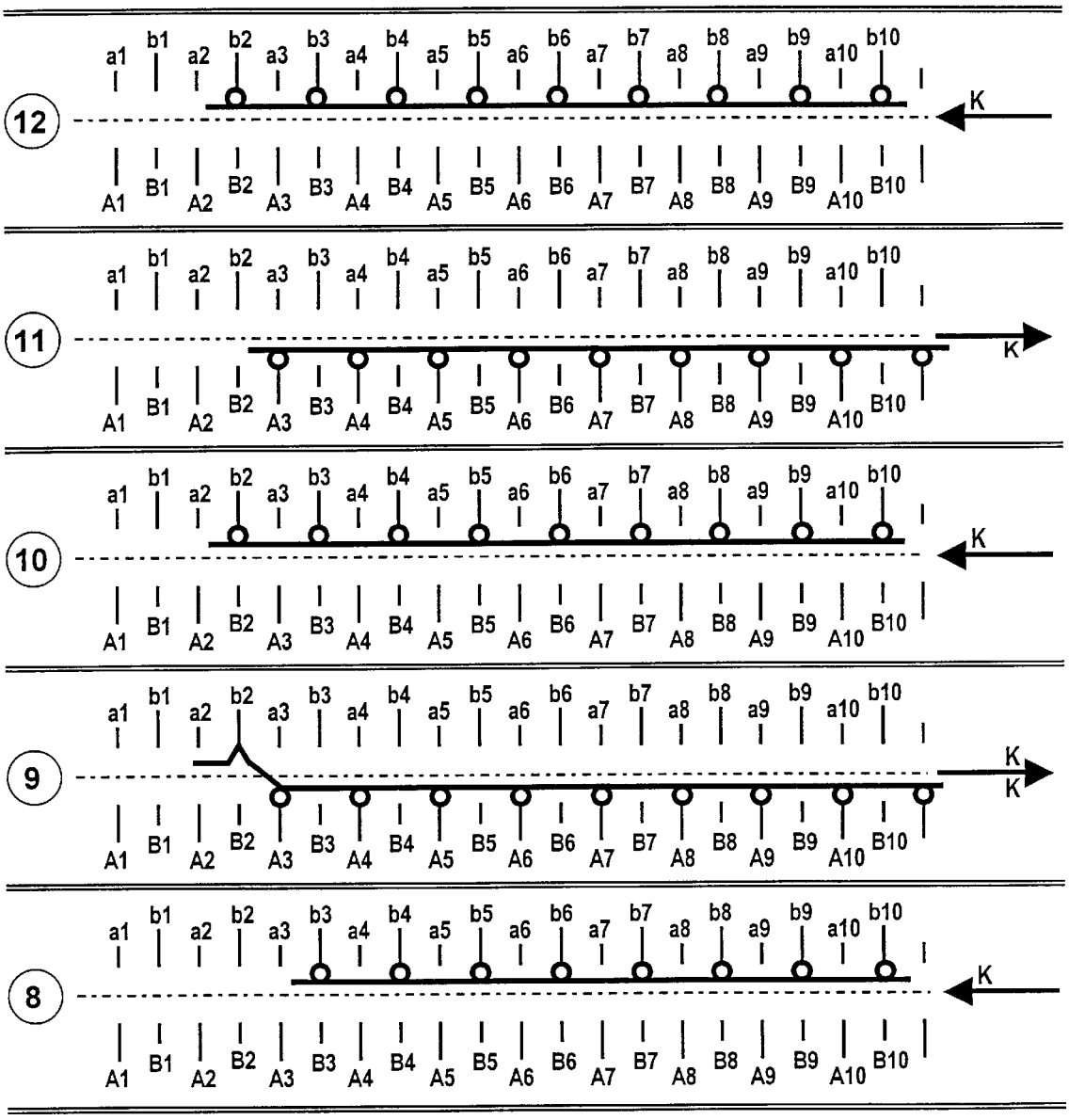
*Fig. 5.2*

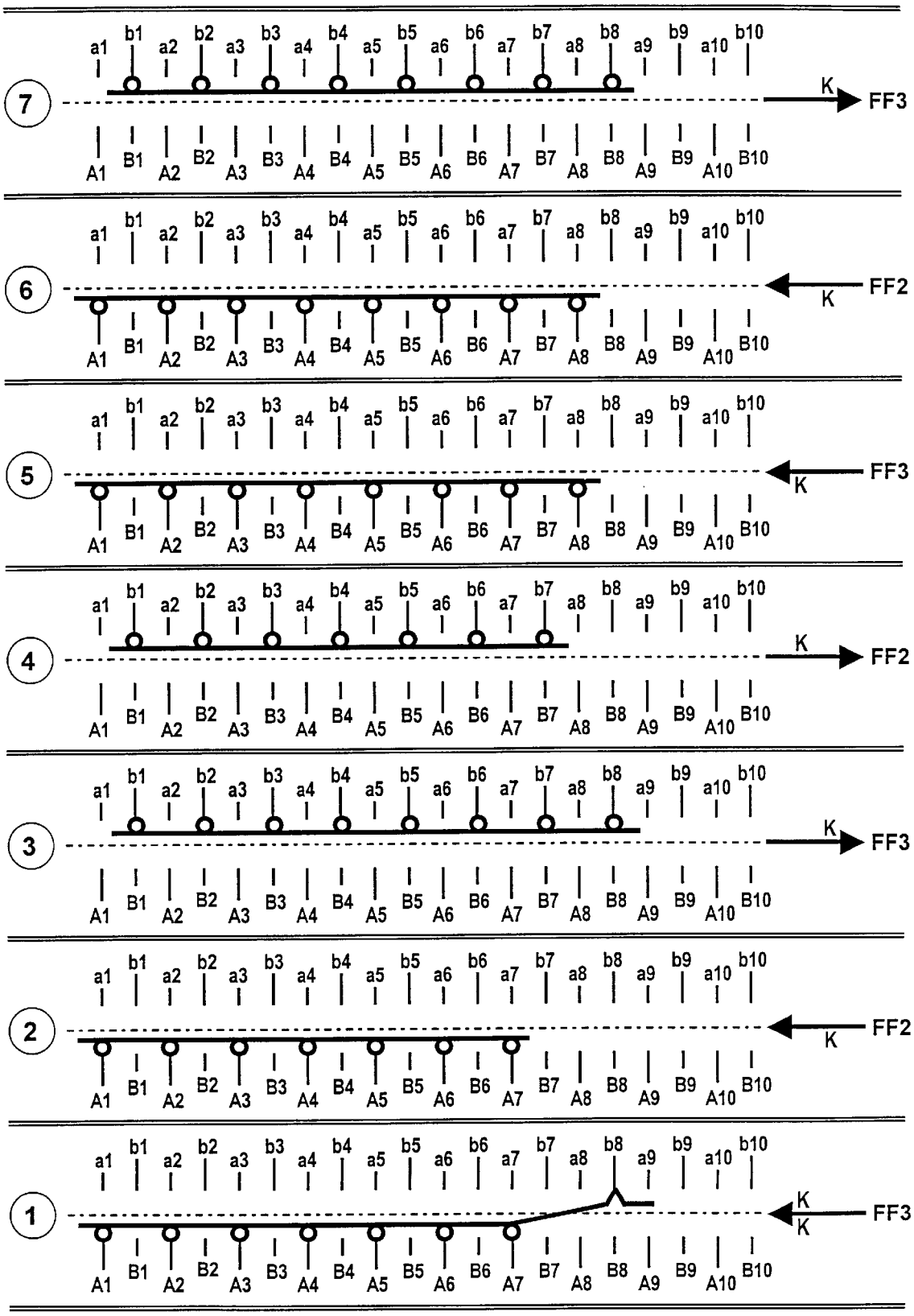
*Fig. 6.1*

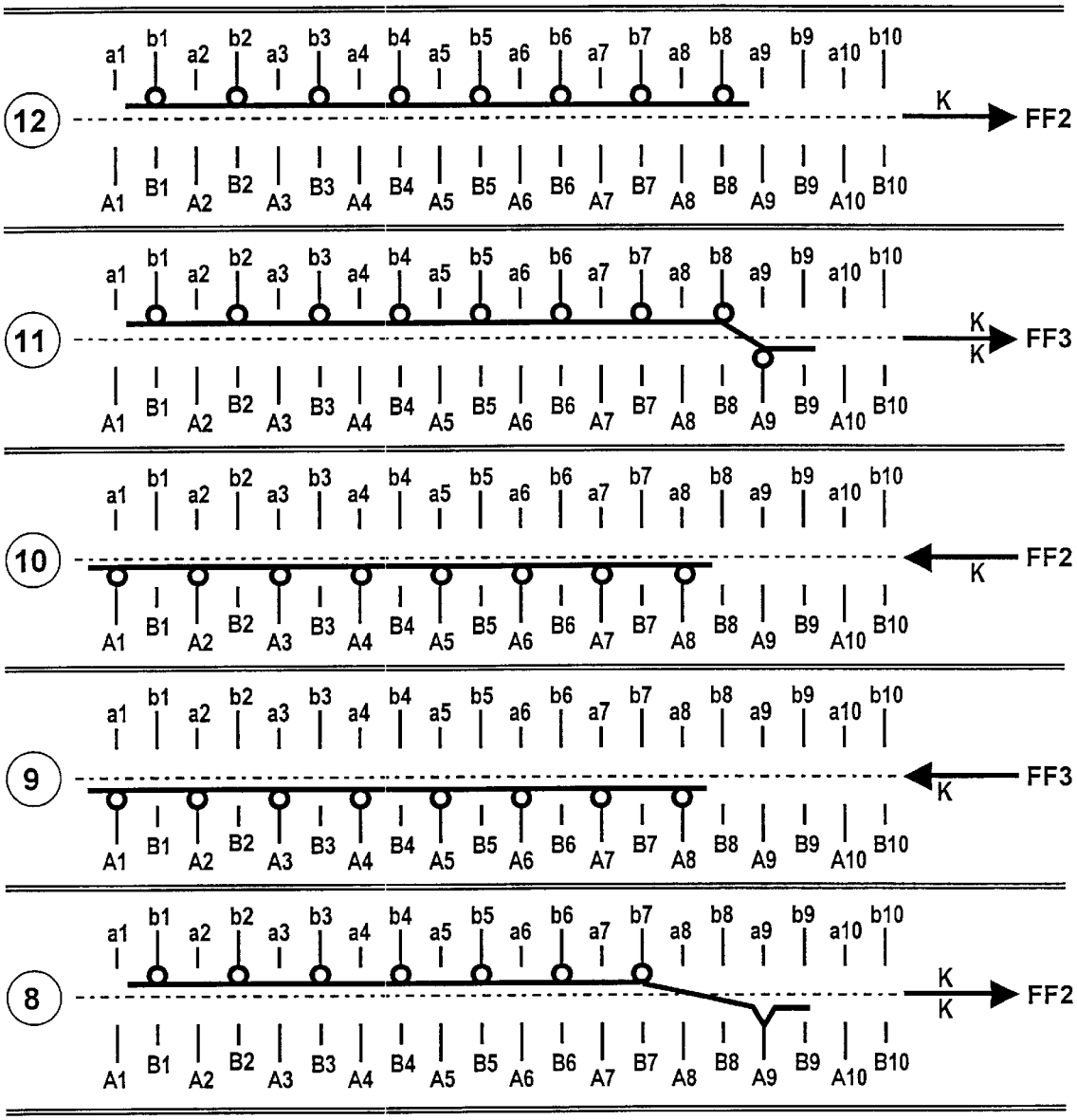
*Fig. 6.2*

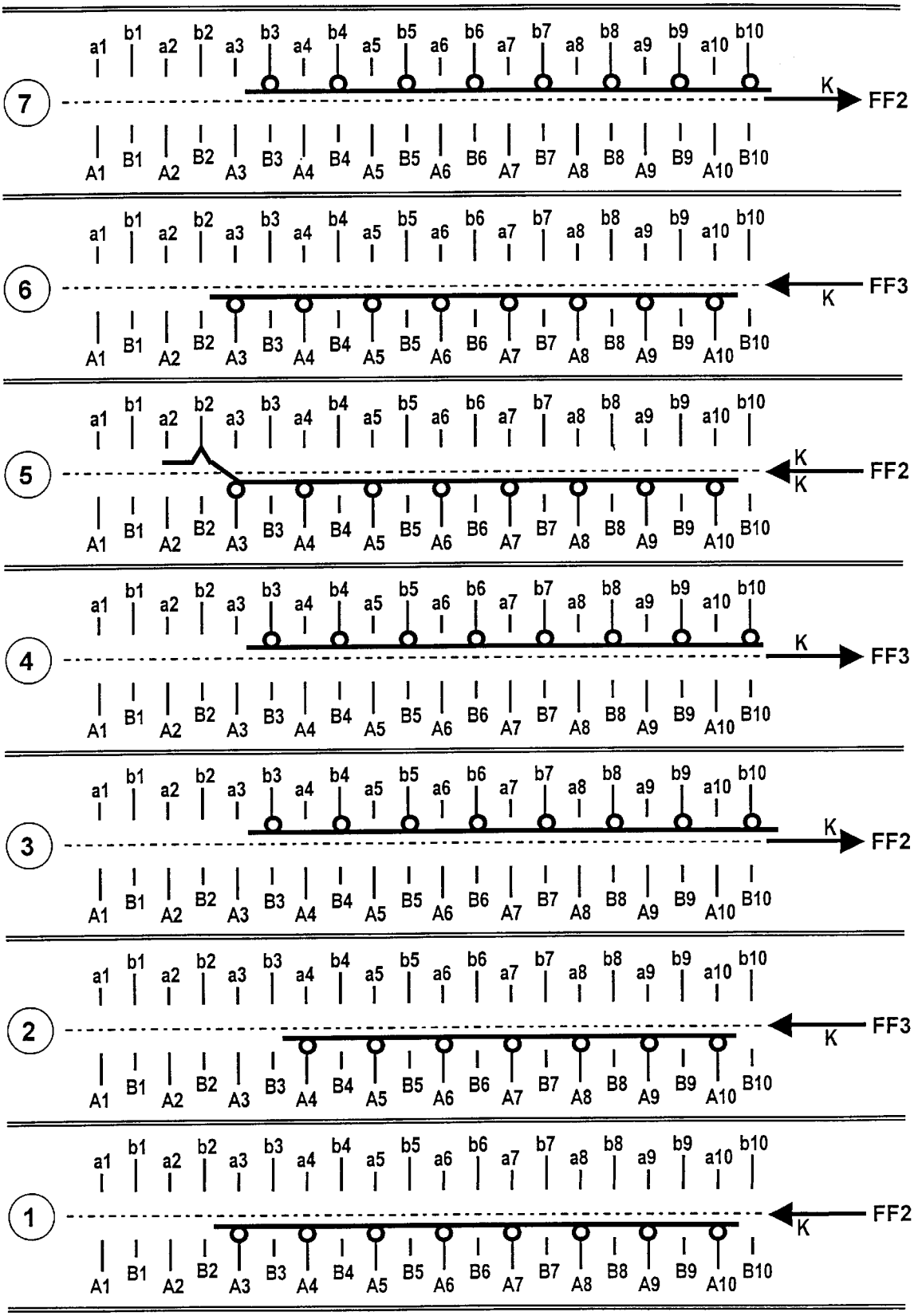
*Fig. 7.1*

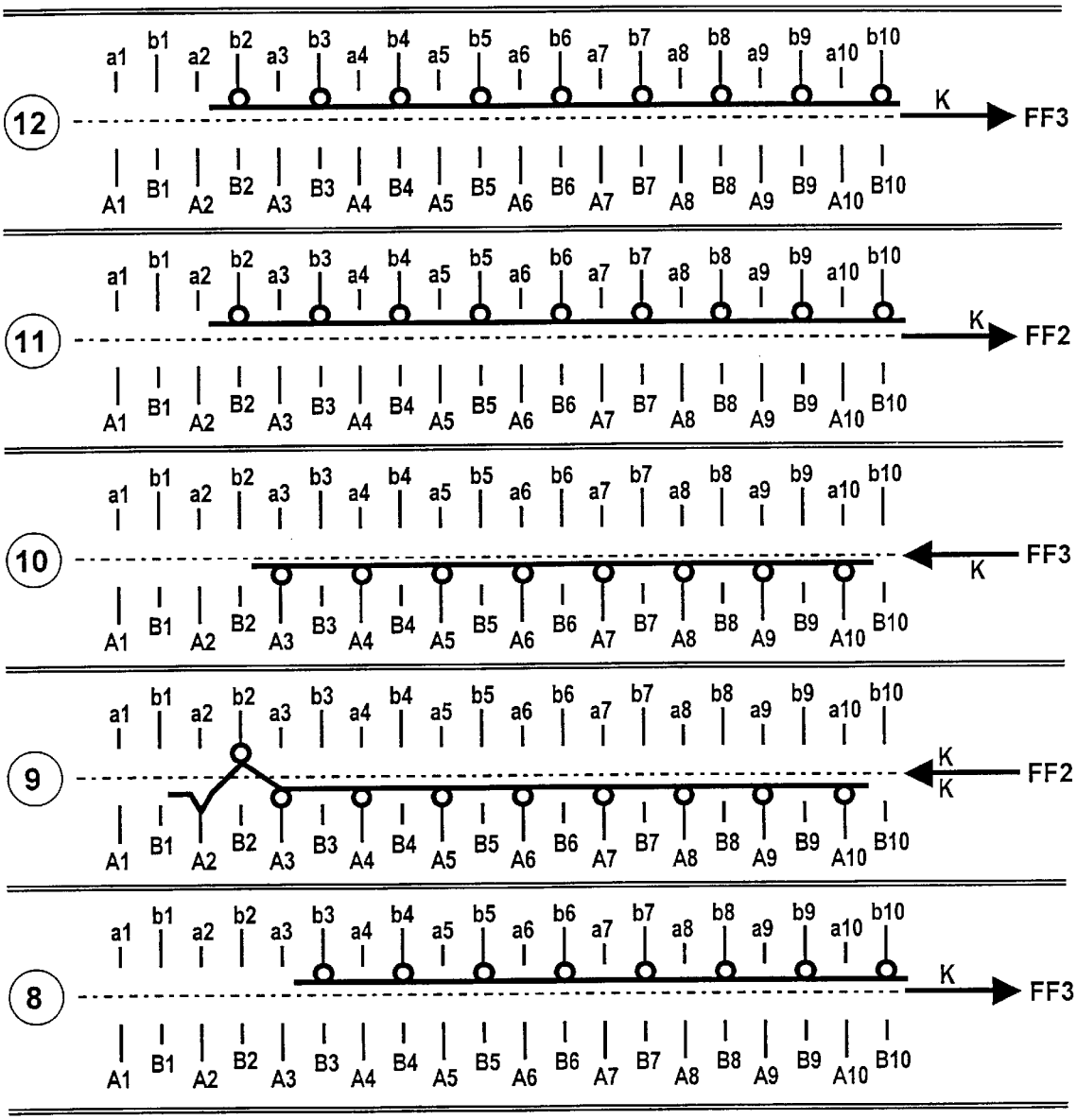
*Fig. 7.2*

TWIN BED FLAT KNITTING MACHINE METHOD FOR WIDENING A TUBULAR FABRIC

BACKGROUND OF THE INVENTION

The present invention relates to a method of mesh widening of a hose shaped knitted piece produced on a two-bed flat knitting machine from two knitted pieces connected with one another at the edges, on one or both lateral edges.

The production of hose-shaped knitted pieces by edge connection of two partial knitted pieces on a flat knitting machine is used for so-called complete knitted pieces, such as pullovers or similar closing pieces. These completed pieces leave the knitting machine approximately ready to wear. No seams have to be closed. However, the thread ends must be cut. During this knitting it is necessary to produce for example the sleeves and body part of the knitted piece as hose-forming structures on the flat knitting machine. This can be achieved by edge connection of two knitted pieces which are suspended opposite to one another on the front and rear needle bed of the flat knitting machine. Depending on the section of the knitted piece to be produced, as a rule, mesh widening of the hose knitted piece on one or both edges is necessary. In closing pieces, the mesh widening in the edge region of the knitted piece is performed so that a tight knitted pattern is provided without disturbing holes and simultaneously the edge connection of both knitted parts remains elastic.

A method of broadening a tubular knitted fabric is disclosed in U.S. Pat. No. 5,701,766. The method of this reference needs several rackings of one of the needle beds. These rackings are illustrated in FIG. 3 in S14, in FIG. 4 in S15 and S17, and in FIG. 5 in S15*b* and S15*c* and in the corresponding parts of the description, for example in column 7, lines 7 and 8 of this reference. The racking of a needle bed is a time consuming procedure. Also, transfer of loops is needed in the method of the reference, and the hooks are twisted in the procedure disclosed in the reference.

SUMMARY OF THE INVENTION

Accordingly, it is an object of present invention to provide a new method of mesh widening of a hose-shaped knitted part on a two bed flat knitting machine which is a further improvement of the existing method.

The method in accordance with the present invention differs from the existing methods in that it does not need racking of one of the needle beds. A racking of a needle bed is a time consuming procedure. It is necessary to stop the machine before the needle bed can rack. This increases the production time and cost of the knitted fabric. It is also necessary in the prior art to transfer the loops. Also, in the existing methods the hooks are twisted.

In contrast, with the utilization of the method in accordance with the present invention no racking of one needle bed is needed. Also, there is no need to transfer the loops, and the hooks are not twisted.

The inventive method is suitable in particular for production of closing pieces, but is not limited to this application. Also, a mesh widening in accordance with the inventive method can be performed for hose-shaped knitting for technical applications.

In keeping with these objects and with others which will become apparent hereinafter, one feature of present invention resides, briefly stated, in a method which includes the following steps: knitting a mesh row in a carriage direction from left to right on a front needle bed and subsequently knitting a mesh row in the carriage direction from right to left on a rear needle bed; knitting a mesh row in the carriage direction from left to right on the front needle bed and forming a loop on a previously free edge needle of the front needle bed; forming a mesh row in the carriage direction from right to left on the rear needle bed; transferring the loop with a first knitting system in the carriage direction from left to right on an empty needle of the rear needle bed with a further knitting system knitting a mesh row on the front needle bed; forming a mesh row in the carriage direction from right to left with cooperation of the edge needle with the loop; knitting a mesh row in the carriage direction from left to right on the front needle bed and then knitting a mesh row in the opposite carriage direction of the rear needle bed; knitting a mesh row in the carriage direction from left to right on the front needle bed and forming a loop on a previously free edge needle of the rear needle bed; forming a mesh row in the opposite carriage direction on the rear needle bed without cooperation of their edge needle with the loop; transferring of the formed loop in the carriage direction from left to right with the first knitting system from the rear needle bed to a needle of the front needle bed, and subsequently forming a mesh row in the same carriage direction with a further knitting system on the front needle bed with cooperation of the needle with the transferring loop; knitting a mesh row in the carriage direction from right to left on the rear needle bed and then knitting a mesh row in the opposite carriage direction on the front needle bed, and then knitting a mesh row on the rear needle bed in the carriage direction from right to left; repeating the steps until a desired length and shape of the knitted piece is achieved.

The second method of the mesh widening includes the steps of knitting a mesh row in a carriage direction from left to right on a front needle bed; knitting a mesh row in the carriage direction from right to left on a rear needle bed; knitting a mesh row in the carriage direction from left to right on the front needle bed and forming a loop on a previously at a right edge of the knitted piece on the rear needle bed; knitting a mesh row in the carriage direction from right to left on the rear needle bed without participation of an edge needle with a loop, and then forming a mesh row in the carriage direction from left to right on the front needle bed; forming a mesh row in the carriage direction from right to left on the rear needle bed with participation of the edge needle with the loop; knitting a mesh row in the carriage direction from left to right on the front needle bed and then in an opposite carriage direction on the rear needle bed, and then again from left to right on the front needle bed; forming a loop in the carriage direction from right to left on a previously empty edge needle of the front needle bed and knitting a mesh row on the rear needle bed; forming a mesh row in the carriage direction from left to right on the front needle bed with cooperation of the edge needle with the loop; knitting a mesh row in the knitting direction from right to left on the rear needle bed; and repeating the steps until a desired length and shape of the knitted piece is obtained.

In accordance with a further embodiment of the present invention, the method includes the steps of producing first a loop with a forward knitting system in a carriage direction from right to left and a first thread guide on a previously empty edge needle of a rear needle bed and then a mesh row on a front needle bed; knitting a further mesh row with a rearward knitting system and a second thread guide on the front needle bed; knitting a mesh row with the front knitting system in opposite carriage direction in the first thread guide on a rear needle bed with cooperation of an edge needle with a loop, and knitting a further mesh row with the rear knitting system and the second thread guide on the rear needle bed with cooperation of the edge needle; forming in the carriage direction from right to left of both knitting system each mesh row on the front needle bed, and in the opposite knitting direction on the rear needle bed, and forming a loop by the rear knitting system and the second thread guide on a previously empty edge needle on the front needle bed; forming one mesh row in the carriage direction from right to left each on the front needle bed with the forward and the rearward knitting system with the use of the first and second thread guides; knitting a mesh row in the opposite carriage direction with the forward knitting system and the first thread guide on the rear needle bed and forming a mesh row with a needle of the front needle bed, before producing a machine row with the rear knitting system and the second thread guide on the rear needle bed; and repeating the steps until a desired length and shape of the knitted piece is obtained.

In the latter mentioned methods a mesh widening is performed at the left or right edge of a hose-shaped knitted piece with the use of at least two knitting systems, whereby an especially high productivity is provided.

It is also possible to combine the method of mesh widening at the left widening with the method of mesh widening at the right edge of mesh widening at the right edge, to obtain a knitted piece with a both-side mesh widening.

In all methods the edge connections are located in the region of the mesh widening of both knitted pieces. The connections are very tight but nevertheless elastic, and thereby with the use of the inventive method for producing closing pieces a high wearing comfort of these closing pieces is guaranteed.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 2.1 to 2.3 are views showing a mesh widening for illustration of a mesh widening of a hose-shaped knitted piece at the right edge in accordance with a first embodiment of the inventive method;

FIGS. 3.1 to 3.3 are views showing a mesh course for illustration of a mesh widening of a hose-shaped knitted piece at its left edge in accordance with the first embodiment of the inventive method;

FIGS. 4.1 to 4.2 are views showing a mesh course for illustration of a mesh widening of a hose-shaped knitted piece at its right edge in accordance with a second embodiment of the inventive method;

FIGS. 5.1 to 5.2 are views showing a mesh course for illustration of the mesh widening of a hose-shaped knitted piece at its left edge in accordance with a second embodiment of the inventive method;

FIGS. 6.1 to 6.2 are views showing a mesh course for illustration of the mesh widening of a hose-shaped knitted piece at its right edge in accordance with a third embodiment of the inventive method; and FIGS. 7.1 to 7.2 are views showing a mesh course for illustration of the mesh widening of a hose-shaped knitted piece at its left edge in accordance with the third embodiment of the inventive method.

DESCRIPTION OF PREFERRED EMBODIMENTS

Figure 1:
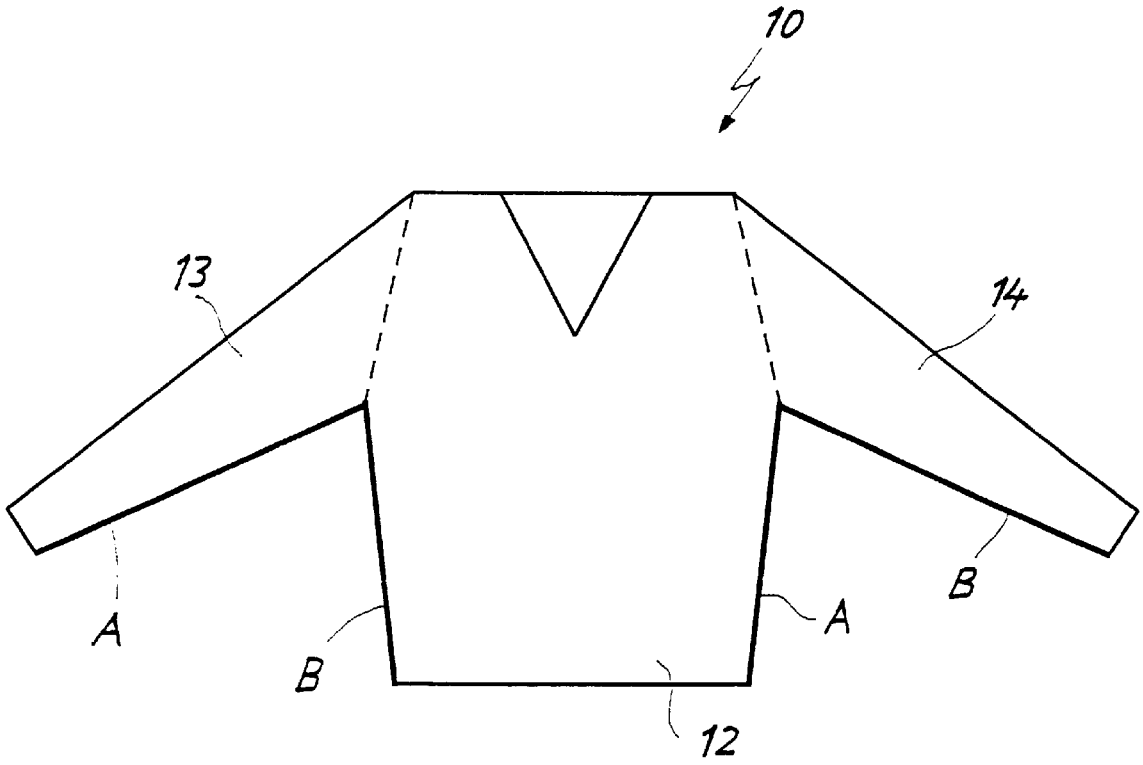
FIG. 1 is a schematic view of a pullover with a mesh widening region on a body part and on the sleeves.

FIG. 1 shows a pullover 10 with a body part 12 and two sleeves 13 and 14 each produced as hose-shaped knitted parts. Both the body part 12 and the sleeves 13 and 14 have mesh widening regions A, B. The widening region at the right edge is identified as A and the widening region at the left end is identified as B.

FIGS. 2.1 to 2.3 show the mesh course of a first method for widening a hose knitted piece at the right edge, as needed for example for production of a left sleeve. Referring to FIG. 2.1 first a mesh row on the front needle bed is needed in a row 1, and then a mesh row on the rear knitted bed is needed in a row 2, before a mesh row is knitted on the front needle bed in a carriage direction from left to right and a loop is produced on a previously free edge needle B8 of the front needle bed. A mesh row is produced on the rear needle bed in a row 4, and subsequently the loop of the needle B8 of the front needle bed is transferred the needle b8 of the rear needle bed in a row 5 in a carriage direction from left to right with the first knitting system. A mesh row is produced on the front needle bed in a row 6 in the same carriage direction from left to right with a further knitting system. A mesh row is knitted on the rear needle bed in a row 7 in the carriage direction from right to left with cooperation of the edge needle b8 with the loop. Subsequently, a mesh row is produced on the front and rear needle bed in rows 8 and 9 (FIG. 2.2) correspondingly, before a mesh row is produced on the front needle bed in a row 10 in the carriage direction from left to right and then a loop is formed on a previously free edge needle a9 of the rear needle bed. Subsequently, a mesh row is knitted on the rear needle bed in a row 11 without cooperation of the edge needle a9, and then the loop is transferred from the edge needle a9 of the rear needle bed in a previously free edge needle a9 of the front needle bed in the carriage direction from left to right with the first knitting system, while a mesh row is formed on the front needle bed with cooperation of the edge needle A9 with a further knitting system in a row 13. In rows 14, 15, and 16 again in (FIG. 2–3) alternatingly mesh rows are knitted on the front and rear needle beds.

Also, in accordance with this method, a widening knitted piece is produced with a tight edge connection, without offset of the needle beds.

FIGS. 3.1 to 3.3 show the widening of a hose-shaped knitted piece on the left edge in accordance with similar method as shown in FIG. 2.1 to 2.3. In the rows 1–3, first alternatingly mesh rows are produced on the front and rear needle beds, before in the row 4 a mesh row is knitted on the rear needle bed in the carriage direction from right to left, and with a previously free needle at the left edge of the sleeve a3 a loop is formed. In the row 5 a mesh row is produced in the carriage direction from left to right on the front needle bed, before in the row 6 the loop is transferred over from the needle a3 of the rear needle bed in a previously free edge needle A3 of the front needle bed in the carriage direction from right to left with the first knitting system, and a mesh row on the rear needle bed is formed with a further knitting system. In the rows 8–10 again alternatingly mesh rows are knitted on the front and rear needle beds and in the row 11 a mesh row is formed on the rear needle bed in the carriage direction from right to left and a loop is produced with a previously free edge needle B2 of the front needle bed. In the row 12 a mesh row is knitted on the front needle bed in the carriage direction from left to right without cooperation of the edge needle B2. In the row 13 a transfer of the loop from the needle B2 of the front needle bed to a needle b2 of the rear needle bed is performed in the carriage direction from right to left with the first knitting system, before in the same knitting system with a second knitting system a mesh row is produced on the rear needle bed with cooperation of the edge needle b2. In the rows 15 and 16, a mesh row is produced on the front and rear needle bed correspondingly.

FIGS. 4.1 and 4.2 show the mesh course of a second method for mesh widening on the right knitted piece side of a hose knitted piece with closed edges, for example the left sleeve of a pullover. In the row 1 a mesh row is formed on the front needle bed in the carriage direction from left to right and subsequently a mesh row is formed on the rear needle bed in the carriage direction from right to left, before in the row 3 again a mesh row is formed on the front needle bed and a loop is produced on the previously empty needle b8 of the rear needle bed. Subsequently, in the row 4 a mesh row is formed in the carriage direction from right to left on the rear needle bed, wherein the needle b8 does not cooperate with the loop. In the row 5 a mesh row is produced on the front needle bed in the carriage direction from left to right, and subsequently in the row 6 a mesh row is knitted on the rear needle bed in the carriage direction from right to left, wherein now the needle b8 cooperates with the loop, or in other words the knitted piece is widened on the rear needle bed by a machine width.

In the subsequent three rows, alternatingly mesh rows are knitted on the front and rear needle bed, before in the row 10 a loop is inserted in the carriage direction from right to left first on a previously free edge needle A9 of the front needle bed, and subsequently a mesh row is knitted on the rear needle bed. In the row 11 a mesh row is produced on the front needle bed in the carriage direction from left to right, wherein the needle A9 cooperates with the loop. Subsequently, a mesh row is produced in the row 12 on the rear needle bed. Now, the knitted piece is widened on the front needle bed also by one mesh. The illustrated method steps can be repeated so often until the knitted piece reaches the desired length and shape. The advantage of this knitting method is that no seam is needed on the knitted piece. The shown type of the edge connection is moreover very tight, or in other words, no non-fine non-uniformities can be seen in the region of the connection on the knitted piece. A further advantage of this type of the mesh widening is that no needle bed offset and no transfer of meshes is needed, whereby the running safety of the machine during knitting of such an article is very high.

FIGS. 5.1 and 5.2 show a method which is analogous to the method of FIG. 4 for widening meshes of a hose knitted product at the left edge, such as for example for the right sleeve of a pullover. First in the row 1 a mesh row is produced on the front needle bed in the carriage direction from left to right. Subsequently, in the row 2 a mesh row is produced on the rear needle bed and a loop is formed on a previously free edge needle A3 of the front needle bed. In the row 3 again a row is formed on the front needle bed, and a needle A3 does not cooperate. In the row 4 a mesh row is knitted on the rear needle bed, and subsequently a mesh row is formed on the front needle bed in the carriage direction from left to right and now the needle A3 does not cooperate with the loop. In this manner the knitted piece is widened on the front needle bed by one mesh width. In the row 6, 7, 8 again alternatingly mesh rows are formed on the rear and front needle beds, before in the row 9 a loop is produced on a previously free edge needle b2 of the rear needle bed in the carriage direction from left to right and subsequently a mesh row is knitted on the front needle bed. In the row 10 a mesh row is produced on the rear needle be bend in the carriage direction from right to left whereas the needle b2 cooperates with the loop. Subsequently, in the rows 11 and 12, a mesh row is produced correspondingly on the front and rear needle beds. Now the knitted piece is widened on the rear needle bed at the left side by one mesh width. The method can be repeated until the desired length and shape of the knitted piece is obtained.

FIGS. 6.1 and 6.2 illustrate a third method of producing a hose knitted with a mesh increase on the right side, for example for producing the left sleeve of a pullover with close lateral edges with the use of at least two knitting systems. In the row 1 a loop is formed on the previously empty needle b8 of the rear needle bed in the carriage direction from right to left with a forward knitting system and a first thread guide FF3, and then with the needles 8 A7 to A1 of the front needle bed the mesh row is finally knitted. In the second row a mesh row is knitted in the same carriage direction with the rearward knitting system with a second thread guide FF2 with the needles A7 to A1 of the front needle bed. In the next row 3 the meshes are produced in the reverse carriage direction with the thread guide FF3 and the forward knitting system with the needles b1 to b8 of the rear needle bed, and in the row 4 with the rearward knitting system with the thread guide FF2 and the needles by to b7 of the rear needle system. In the rows 5 and 6 in another reverse of the carriage direction the meshes are knitted with the thread guide FF3 forwardly and with the thread guide FF2 rearwardly and the needles A8 to A1 of the front needle bed.

In the row 7 the needles b1 to b8 of the rear needle bed knit from left to right forwardly with the thread guide FF3. In the row 8 with the same carriage direction knitting is performed with the rearward knitting system and the thread guide FF2 as well as the needles b1 to b7 of the rear needle bed, and a loop is formed on the previously empty needle A9 of the front needle bed. In both following rows 9 and 10 one mesh row is knitted after the carriage reverse with the forward knitting system and the thread guide FF3 and the rearward knitting system and the thread guide FF2 with the needles A8 to A1 of the front needle bed. In the following row 11, a mesh row is knitted in the carriage direction from left to right with the forward knitting system and the thread guide FF3 and the needles b1 to b8 of the rear needle system, and a mesh is produced with the needle A9 with the forward needle bed. Subsequently, in the row 12 in the same knitting direction a mesh row is produced with the rearward knitting system and the thread guide FF2 and the needles b1 to b8 of the rear needle bed. The rows 11–12 can be subsequently repeated so-often until the desired length and strength of the knitted piece is obtained. This type of the mesh formation is very tight, or in other words none-fine openings in the region of the edge connection is produced. An offset of the needle beds relative to one another is superfluous. Moreover, by knitting of at least two knitting systems a higher productivity is obtained since in each carriage direction at least two mesh row is produced.

In FIG. 5 of a hose shaped knitted piece at the left edge is shown in a similar manner as in FIG. 6. In the first row a mesh row is knitted in the carriage direction from right to left with the forward knitting system and a first thread guide FF2 and the needles A10 to A3 of the front needle bed. In the second mesh row knitting is performed in the same carriage direction with the rearward knitting system at a second thread guide FF3 and the needles A10 to A4 of the front needle bed. In the rows 3 and 4, two mesh rows are produced in the reverse carriage direction first with the forward knitting system and the thread guide FF2 and subsequently with the rearward knitting system and the thread guide FF3 and the needles b3 b10. In the row 5, a mesh row is produced in the carriage direction from right to left with the forward knitting system with the thread guide FF2 and the needles A10 to A3 on the front needle bed, and a loop is formed with the previously empty needle b2 of the rear needle bed. In the row 6 a mesh row is formed in the same carriage direction with the rearward knitting system and the thread guide FF3 and the needles A10 to A3 of the front needle bed.

In the rows 7 and 8, one mesh row is produced each in the reverse carriage direction first with the forward knitting system and the thread guide FF2 and then with the rearward knitting system and the thread guide FF3 as well as b2 to b11 of the rear needle bed. Subsequently in the row 9, knitting is performed in the carriage direction from right to left with the forward knitting system and the thread guide FF2 as well as the needles A10 to A3 of the front needle bed as well as the needle b2 of the rear needle bed, and a loop is formed on the previously empty needle A2 of the forward needle bed. In the row 10, a mesh row is produced in the same carriage direction with the rearward knitting system and the thread guide FF3 by means of the needles A10 to A3 of the front needle bed. In the rows 11 and 12 a mesh row is formed each in the reverse carriage direction first with the forward knitting system and the thread guide FF2 and with the rearward knitting system and the thread guide FF3 on the needles B2 to B10 of the rear needle bed. This process can be repeated as long as the desired length and shape of the knitting piece is obtained.

It will be understood that each of the elements described above, or two or more together, may also find a useful application in other types of methods differing from the types described above.

While the invention has been illustrated and described as embodied in method of mesh widening of hose-shaped knitted piece produced on a two-bed flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A method of mesh widening of a hose-shaped knitted piece produced on a double flat knitting machine from two knitted parts connected with one another at edges, with the use of a knitting system and a thread guide, the method comprising the steps of knitting a mesh row in a carriage direction from left to right on a front needle bed and subsequently knitting a mesh row in the carriage direction from right to left on a rear needle bed;

knitting a mesh row in the carriage direction from left to right on the front needle bed and forming a loop on a previously free edge needle of the front needle bed;

forming a mesh row in the carriage direction from right to left on the rear needle bed;

transferring the loop with a first knitting system in the carriage direction from left to right on an empty needle of the rear needle bed with a further knitting system knitting a mesh row on the front needle bed;

forming a mesh row in the carriage direction from right to left with cooperation of the edge needle with the loop;

knitting a mesh row in the carriage direction from left to right on the front needle bed and then knitting a mesh row in the opposite carriage direction of the rear needle bed;

knitting a mesh row in the carriage direction from left to right on the front needle bed and forming a loop on a previously free edge needle of the rear needle bed;

forming a mesh row in the opposite carriage direction on the rear needle bed without cooperation of their edge needle with the loop;

transferring the formed loop in the carriage direction from left to right with the first knitting system from the rear needle bed to a needle of the front needle bed;

and subsequently forming a mesh row in the same carriage direction with a further knitting system on the front needle bed with cooperation of the needle with the transfer loop;

knitting a mesh row in the carriage direction from right to left on the rear needle bed and then knitting a mesh row in the opposite carriage direction on the front needle bed;

and then knitting a mesh row on the rear needle bed in the carriage direction from right to left; and repeating the all preceding steps until a desired length and shape of the knitted piece is achieved.

2. A method of mesh widening of a hose-shaped knitted piece is produced from two knitted parts connected with one another on a double flat knitting machine with the use of a knitting system and a thread guide, the method comprising the steps of forming a mesh row in a carriage direction from left to right on a front needle bed and subsequently forming a mesh row in an opposite carriage direction on a rear needle bed;

forming a mesh row in the carriage direction from left to right on the front needle bed;

knitting a mesh row in the opposite carriage direction on the rear needle bed and forming a loop in a previously free edge needle of the rear needle bed;

knitting a mesh row in the carriage direction from left to right on the front needle bed;

transferring the loop in the carriage direction from right to left with a first knitting system on the rear needle bed in an empty edge needle of the front needle bed and knitting a mesh row with a further knitting system of a rear needle bed;

knitting a mesh row in the carriage direction from left to right on the front needle bed with cooperation with the edge needle with the loop;

knitting a mesh row in the carriage direction from right to left on the rear needle bed and then knitting a mesh row from left to right on the front needle bed;

knitting a mesh row in the carriage direction from right to left on the rear needle bed and forming a loop with a previously free edge needle of the front needle bed;

knitting a mesh row in the opposite carriage direction on the front needle bed;

transferring the edge needle of the rear needle bed in the carriage direction from right to left with the first knitting system and subsequently knitting a mesh row in the same carriage direction with a further knitting system on the rear needle bed with cooperation of the edge needle with the loop;

knitting a mesh row in the carriage direction from left to right on the front needle bed and subsequently knitting a mesh row in the opposite carriage direction on the rear needle bed;

and repeating the all preceding steps until the knitted piece reaches a desired length and shape.

3. A method of mesh widening of a hose-shaped knitted piece produced on a double flat knitting machine from two knitting parts connected with one another at their edges, with the use of a knitting system and a thread guide, the method comprising the steps of knitting a mesh row in a carriage direction from left to right on a front needle bed;

knitting a mesh row in the carriage direction from right to left on a rear needle bed;

knitting a mesh row in the carriage direction from left to right on the front needle bed and forming a loop on a previously at a right edge of the knitted piece on the rear needle bed;

knitting a mesh row in the carriage direction from right to left on the rear needle bed without participation of an edge needle with a loop, and then forming a mesh row in the carriage direction from left to right on the front needle bed;

forming a mesh row in the carriage direction from right to left on the rear needle bed with participation of the edge needle with the loop;

knitting a mesh row in the carriage direction from left to right on the front needle bed and then in an opposite carriage direction on the rear needle bed, and then again from left to right on the front needle bed;

forming a loop in the carriage direction from right to left on a previously empty edge needle of the front needle bed and knitting a mesh row on the rear needle bed;

forming a mesh row in the carriage direction from left to right on the front needle bed with cooperation of the edge needle with the loop;

knitting a mesh row in the knitting direction from right to left on the rear needle bed;

and repeating the all preceding steps until a desired length and shape of the knitted piece is obtained.

4. A method of mesh widening of a knitted piece produced on a double flat knitting machine from two knitted parts connected with one another at edges with the use of a knitting system and a thread guide, the method comprising the steps of forming a mesh row in a carriage direction from left to right on a front needle bed;

knitting a mesh row in the carriage direction from right to left on a rear needle bed and forming a loop on a previously empty edge needle at a left end of the knitted piece on the front needle bed;

knitting a mesh row in the carriage direction from left to right on the front needle bed without cooperation with an edge needle;

knitting a mesh row in an opposite carriage direction on the rear needle bed;

knitting a mesh row in the carriage direction from left to right on the front needle bed with cooperation of the edge needle with the loop;

knitting a mesh row first in the carriage direction from right to left of the rear needle bed and then in the carriage direction from left to right on the front needle bed and then again in the carriage direction from right to left on the rear needle bed;

forming a loop in the carriage direction from left to right on a previously empty edge needle of the rear needle bed and subsequently knitting a mesh row on the front needle bed;

forming a mesh row in the carriage direction from right to left on the rear needle bed with cooperation of the edge needle;

forming a mesh row in the carriage direction from left to right on the front needle bed and subsequently forming a mesh row in the carriage direction from right to left on the rear needle bed;

and repeating the all preceding steps until a desired length and shape of the knitted piece is obtained.

5. A method of mesh widening of a hose-shaped knitted piece produced on a double bed flat knitting machine from two knitted parts connected with one another at edges, the method comprising the steps of producing first a loop with a forward knitting system in a carriage direction from right to left and a first thread guide on a previously empty edge needle of a rear needle bed and then a mesh row on a front needle bed;

knitting a further mesh row with a rearward knitting system and a second thread guide on the front needle bed;

knitting a mesh row with the front knitting system in the first thread guide on a rear needle bed with cooperation of an edge needle with a loop;

knitting a further mesh row with the rear knitting system and the second thread guide on the rear needle bed with cooperation of the edge needle;

forming in the carriage direction from right to left of both knitting systems each mesh row on the front needle bed, and in the opposite knitting direction on the rear needle bed;

forming a loop by the rear knitting system and the second thread guide on a previously empty edge needle on the front needle bed;

forming one mesh row in the carriage direction from right to left each on the front needle bed with the forward and the rearward knitting system with the use of the first and second thread guides;

knitting a mesh row in the opposite carriage direction with the forward knitting system and the first thread guide on the rear needle bed and forming a mesh row with a needle of the front needle bed, before producing a machine row with the rear knitting system and the second thread guide on the rear needle bed;

and repeating the all preceding steps until a desired length and shape of the knitted piece is obtained.

6. A method of mesh widening of a hose-shaped knitted piece produced on a double flat knitting machine from two knitted parts connected with one another at edges, the method comprising the steps of knitting a mesh row with a forward knitting system in a carriage direction from right to left and a first thread guide on a front needle bed;

forming a loop on a previously empty edge needle of a rear needle bed;

subsequently knitting a further mesh row by a rearward knitting system on the front needle bed;

knitting a mesh system in the opposite carriage direction correspondingly by a forward and then the rearward knitting system on the rear needle bed, so that the edge needle does not cooperate with the loop;

before a mesh row is formed on the front needle bed with a new carriage direction from right to left with the forward knitting system and the first thread guide, knitting the loop on the edge needle of the rear needle bed and forming a loop on a previously empty edge needle on the front needle bed;

and repeating the all preceding steps until a desired length and shape of the knitted piece is obtained.

7. A method of mesh widening of a hose-shaped knitted piece produced on a double bed flat knitting machine from two knitted parts connected with one another at the edges, the method comprising the steps knitting a mesh row in a carriage direction from left to right on a front needle bed and subsequently knitting a mesh row in the carriage direction from right to left on a rear needle bed;

knitting a mesh row in the carriage direction from left to right on the front needle bed and forming a loop on a previously free edge needle of the front needle bed;

forming a mesh row in the carriage direction from right to left on the rear needle bed;

transferring the loop with a first knitting system in the carriage direction from left to right on an empty needle of the rear needle bed;

with a further knitting system knitting a mesh row on the front needle bed;

forming a mesh row in the carriage direction from right to left with cooperation of the edge needle with the loop;

knitting a mesh row in the carriage direction from left to right on the front needle bed and then knitting a mesh row in the opposite carriage direction of the rear needle bed;

knitting a mesh row in the carriage direction from left to right on the front needle bed and forming a loop on a previously free edge needle of the rear needle bed;

forming a mesh row in the opposite carriage direction on the rear needle bed without cooperation of the edge needle with the loop;

transferring of the formed loop in the carriage direction from left to right with the first knitting system from the rear needle bed to a needle of the front needle bed;

subsequently forming a mesh row in the same carriage direction with a further knitting system on the front needle bed with cooperation of the needle with the transfer loop;

knitting a mesh row in the carriage direction from right to left on the rear needle bed and then knitting a mesh row in the opposite carriage direction on the front needle bed;

then knitting a mesh row on the rear needle bed in the carriage direction from right to left;

repeating the all preceding steps until a desired length and shape of the knitted piece is achieved;

knitting a mesh row in a carriage direction from left to right on a front needle bed;

knitting a mesh row in the carriage direction from right to left on a rear needle bed;

knitting a mesh row in the carriage direction from left to right on the front needle bed and forming a loop at the right edge of the knitted piece on the rear needle bed;

knitting a mesh row in the carriage direction from right to left on the rear needle bed without participation of an edge needle with a loop;

then forming a mesh row in the carriage direction from left to right on the front needle bed;

forming a mesh row in the carriage direction from right to left on the rear needle bed with participation of the edge needle with the loop;

knitting a mesh row in the carriage direction from left to right on the front needle bed and then in an opposite carriage direction on the rear needle bed, and then again from left to right on the front needle bed;

forming a loop in the carriage direction from right to left on a previously empty edge needle of the front needle bed and knitting a mesh row on the rear needle bed;

forming a mesh row in the carriage direction from left to right on the front needle bed with cooperation of the edge needle with the loop;

knitting a mesh row in the knitting direction from right to left on the rear needle bed;

and repeating the all preceding steps until a desired length and shape of the knitted piece is obtained;

producing first a loop with a forward knitting system in a carriage direction from right to left and a first thread guide on a previously empty edge needle of a rear needle bed and then a mesh row on a front needle bed;

knitting a further mesh row with a rearward knitting system and a second thread guide on the front needle bed;

knitting a mesh row with the front knitting system in opposite carriage direction in the first thread guide on a rear needle bed with cooperation of an edge needle with a loop;

knitting a further mesh row with the rear knitting system and the second thread guide on the rear needle bed with cooperation of the edge needle;

forming in the carriage direction from right to left of both knitting system each mesh row on the front needle bed, and in the opposite knitting direction on the rear needle bed;

forming a loop by the rear knitting system and the second thread guide on a previously empty edge needle on the front needle bed;

forming one mesh row in the carriage direction from right to left each on the front needle bed with the forward and the rearward knitting system with the use of the first and second thread guides;

knitting a mesh row in the opposite carriage direction with the forward knitting system and the first thread guide on the rear needle bed and forming a mesh row with a needle of the front needle bed, before producing a machine row with the rear knitting system and the second thread guide on the rear needle bed;

and repeating the all preceding steps until a desired length and shape of the knitted piece is obtained.

8. A method of mesh widening of a knitted piece produced on a double flat knitting machine from two knitting parts connected with one another at edges, the method comprising the steps of forming a mesh row in a carriage direction from left to right on a front needle bed and subsequently forming a mesh row in an opposite carriage direction on a rear needle bed;

forming a mesh row in the carriage direction from left to right on the front needle bed;

knitting a mesh row in the opposite carriage direction on the rear needle bed and forming a loop in a previously free edge needle of the rear needle bed;

knitting a mesh row in the carriage direction from left to right on the front needle bed;

transferring the loop in the carriage direction from right to left with a first knitting system on the rear needle bed in an empty edge needle of the front needle bed and knitting a mesh row with a further knitting system of the rear needle bed;

knitting a mesh row in the carriage direction from left to right on the front needle bed with cooperation with the edge needle with the loop;

knitting a mesh row in the carriage direction from right to left on the rear needle bed and then knitting a mesh row from left to right on the front needle bed;

knitting a mesh row in the carriage direction from right to left on the rear needle bed and forming a loop with a previously free edge needle of the front needle bed;

knitting a mesh row in the opposite carriage direction on the front needle bed;

transferring the edge needle of the rear needle bed in the carriage direction from right to left with the first knitting system and subsequently knitting a mesh row in the same carriage direction with a further knitting system on the rear needle bed with cooperation of the edge needle with the loop;

knitting a mesh row in the carriage direction from left to right on the front needle bed and subsequently knitting a mesh row in the opposite carriage direction on the rear needle bed;

and repeating the steps until the knitted piece reaches a desired length and shape;

forming a mesh row in a carriage direction from left to right on a front needle bed;

knitting a mesh row in the carriage direction from right to left on a rear needle bed and forming a loop on a previously empty edge needle at a left end of the knitted piece on the front needle bed;

knitting a mesh row in the carriage direction from left to right on the front needle bed without cooperation with an edge needle;

knitting a mesh row in an opposite carriage direction on the rear needle bed;

knitting a mesh row in the carriage direction from left to right on the front needle bed with cooperation of the edge needle with the loop;

knitting a mesh row first in the carriage direction from right to left of the rear needle bed and then in the carriage direction from left to right on the front needle bed and then again in the carriage direction from right to left on the rear needle bed;

forming a loop in the carriage direction from left to right on a previously empty edge needle of the rear needle bed and subsequently knitting a mesh row on the front needle bed;

forming a mesh row in the carriage direction from right to left on the rear needle bed with cooperation of the edge needle;

forming a mesh row in the carriage direction from left to right on the front needle bed and subsequently forming a mesh row in the carriage direction from right to left on the rear needle bed;

repeating the steps until a desired length and shape of the knitted piece is obtained;

knitting a mesh row with a forward knitting system in a carriage direction from right to left and a first thread guide on a front needle bed;

forming a loop on a previously empty edge needle of a rear needle bed;

subsequently knitting a further mesh row by the rearward knitting system on the front needle bed;

knitting a mesh system in the opposite carriage direction correspondingly by the forward and then rearward knitting system on the rear needle bed, so that the edge needle does not cooperate with the loop;

before a mesh row is formed on the front needle bed with a new carriage direction from right to left with the forward knitting system and the first thread guide, knitting down the loop on the edge needle of the rear needle bed and forming a loop on a previously empty edge needle on the front needle bed;

and repeating the all preceding steps until a desired length and shape of the knitted piece is obtained.

* * * * *